US008327787B2

(12) United States Patent
Achord

(10) Patent No.: US 8,327,787 B2
(45) Date of Patent: Dec. 11, 2012

(54) ROTATING SPRAY HEAD AND SYSTEM FOR INDUCED SUCTION GENERATION

(75) Inventor: Cecil L. Achord, Virginia Beach, VA (US)

(73) Assignee: Seward Marine Services Inc., Norfolk, VA (US)

( * ) Notice: Subject to any disclaimer, the term of this patent is extended or adjusted under 35 U.S.C. 154(b) by 438 days.

(21) Appl. No.: 12/800,865

(22) Filed: May 25, 2010

(65) Prior Publication Data

US 2010/0301139 A1 Dec. 2, 2010

Related U.S. Application Data

(60) Provisional application No. 61/217,406, filed on May 29, 2009.

(51) Int. Cl.

| | |
|---|---|
| ***B63B 59/00*** | (2006.01) |
| ***E04H 4/16*** | (2006.01) |
| ***A47L 5/16*** | (2006.01) |
| ***B05B 3/00*** | (2006.01) |

(52) U.S. Cl. ..... 114/222; 15/1.7; 15/409; 239/225.1; 239/380

(58) Field of Classification Search ..... 239/225.1, 239/380, 214, 223, 224; 248/309.1, 309.3; 114/221 R, 222; 15/1.7, 409; 134/21, 119, 134/134

See application file for complete search history.

(56) References Cited

U.S. PATENT DOCUMENTS

| | | | | |
|---|---|---|---|---|
| 4,107,816 | A * | 8/1978 | Matthews | 15/320 |
| 4,168,562 | A * | 9/1979 | Maasberg | 15/320 |
| 4,314,521 | A * | 2/1982 | Lundberg | 114/222 |
| 4,574,722 | A * | 3/1986 | Orita et al. | 114/222 |
| 4,926,775 | A * | 5/1990 | Andorsen | 114/222 |
| 6,070,547 | A | 6/2000 | Achord | |
| 7,699,066 | B2 * | 4/2010 | Andersen et al. | 134/123 |

* cited by examiner

*Primary Examiner* — Dinh Q Nguyen
*Assistant Examiner* — Justin Jonaitis
(74) *Attorney, Agent, or Firm* — Peter J. Van Bergen

(57) ABSTRACT

A support head capable of generating suction upon the rotation thereof has a body that defines a first surface, a second surface opposing the first surface, a peripheral edge, and an open region formed in a central portion of the second surface. Work producing elements such as spray nozzles are mounted in the first surface. Each of a first plurality of holes extends between the first surface and the second surface. Each of a second plurality of holes extends between the peripheral edge of the body and the open region of the body. When the body is positioned over the surface with the first surface opposing same, suction forces are generated as the body is rotated.

22 Claims, 4 Drawing Sheets

ROTATING SPRAY HEAD AND SYSTEM FOR INDUCED SUCTION GENERATION

ORIGIN OF THE INVENTION

Pursuant to 35 U.S.C. §119, the benefit of priority from provisional application 61/217,406, with a filing date of May 29, 2009, is claimed for this non-provisional application.

FIELD OF THE INVENTION

The invention relates generally to sprayers that dispense pressurized fluid, and more particularly to a spray head and system that induces suction in order to hold the spray head adjacent to a surface as the spray head is rotated.

BACKGROUND OF THE INVENTION

Ship hulls must be periodically cleaned of bio-fouling to maintain a ship's hydrodynamic and fuel efficiency. Currently, such cleaning is performed using a rotating-brush cleaning system such as the one disclosed in U.S. Pat. No. 6,070,547. This type of cleaning system works well on ship hulls coated with conventional anti-fouling coatings designed to impede or slow the development and growth of bio-fouling.

New state-of-the-art ship hull coatings (commonly called "easy release coatings") are self-cleaning when a ship is moving at sea. However, it has been discovered that these new coatings are subject to bio-fouling development and growth when a ship is in port for an extended period of a month or longer. Accordingly, even these new easy release coatings require cleaning when a ship is in port. Unfortunately, rotating-brush cleaning systems damage these new easy release coatings.

SUMMARY OF THE INVENTION

Accordingly, it is an object of the present invention to provide brushless cleaner.

Another object of the present invention is to provide a spray head and rotational system therefore that holds the spray head adjacent to a non-horizontal surface (e.g., a ship's hull) without damaging the surface.

Other objects and advantages of the present invention will become more obvious hereinafter in the specification and drawings.

In accordance with the present invention, a support head capable of generating suction upon the rotation thereof is provided. A body defines a first surface, a second surface opposing the first surface, and a peripheral edge. The body further defines an open region formed in a central portion of the second surface. Work producing elements such as spray nozzles are mounted in the first surface. A first plurality of holes and a second plurality of holes are formed through the body. Each of the first plurality of holes extends between the first surface and the second surface. Each of the second plurality of holes extends between the peripheral edge of the body and the open region of the body. When the body is positioned over the surface with the first surface opposing same, suction forces are generated as the body is rotated where the suction forces can be used to maintain the body adjacent to a non-horizontal surface.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
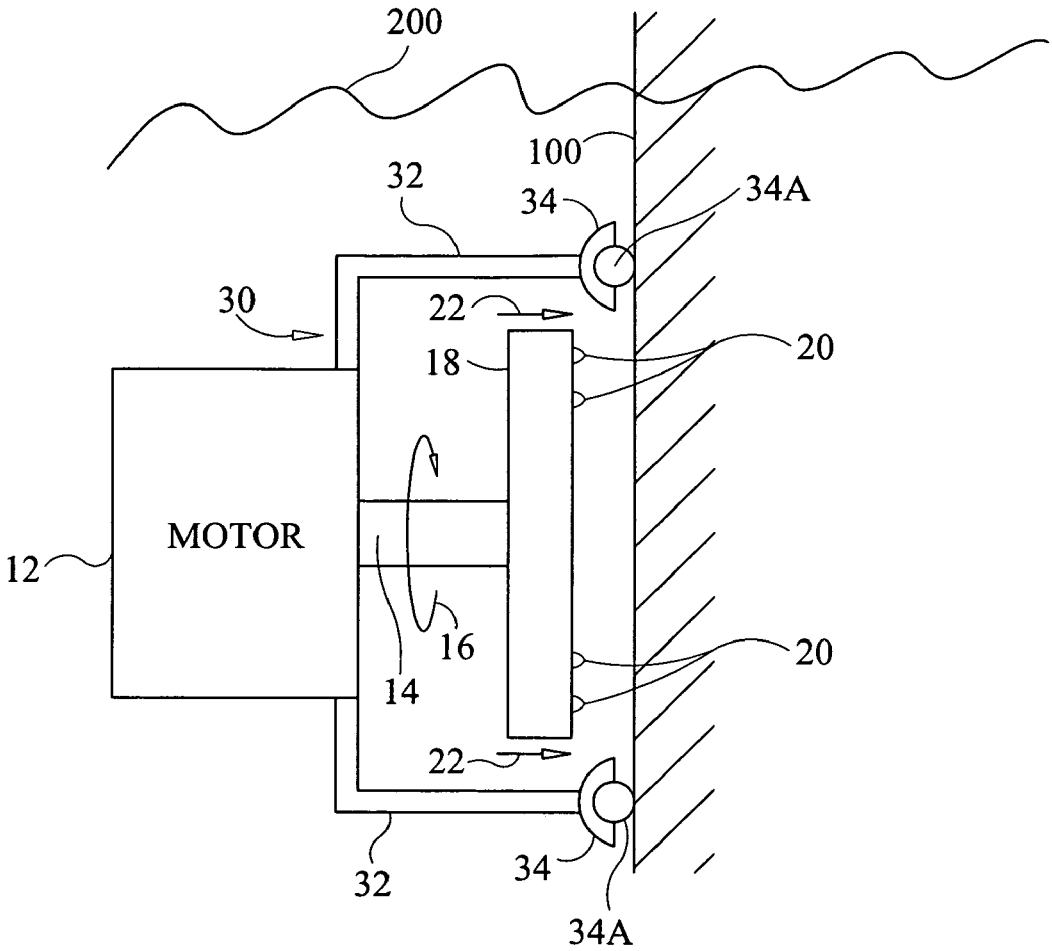
FIG. 1 is a schematic view of a spray head and rotating system therefore in accordance with an embodiment of the present invention.

Referring now to the drawings, and more particularly to FIG. 1, a spray head and system for supporting and rotating same in accordance with an embodiment of the present invention is shown and is referenced generally by numeral 10. System 10 is shown riding on a non-horizontal surface 100 that is to be sprayed (e.g., for cleaning purposes) as it moves thereover. For example, surface 100 could be a portion of a ship's hull that is under the surface of a body of water 200. However, it is to be understood that system 10 could be used to spray any surface regardless of its orientation or surrounding fluid environment (e.g., air).

System 10 can include the following:

- a motor 12;
- a spindle 14 coupled to and extending from motor 12 for rotation thereby as indicated by arrow 16;
- a spray head 18 coupled to spindle 14 for rotation therewith in a spaced apart fashion with respect to surface 100;
- spray nozzles 20 coupled to one face of spray head 18 that opposes and is adjacent to surface 100 when system 10 is placed on surface 100; and
- a carriage assembly 30 coupled to the combination of motor 12/spindle 14/spray head 18 such that spray nozzles 20 are positioned at a select standoff distance from surface 100 as spray head 18 is moved over surface 100.

Motor 12 is any conventional motor that can operate in the fluid environment of interest and can generate rotational power to rotate spindle 14 and spray head 18 at a desired rotational speed. Motor 12 can be an adjustable speed motor to provide for adjustable rates of rotation 16. The motor's existing or provided casing can also serve as the attachment/support points for carriage assembly 30. Spindle 14 can be provided as part of motor 12 or could be coupled thereto without departing from the scope of the present invention. Spindle 14 can include various interface couplings (not shown) for coupling to motor 12 and/or spray head 18 as would be understood in the art. Motor 12/spindle 14 are exemplary of a rotational drive structure for spray head 18. Therefore, it is to be understood that other rotational drive structures (e.g., those using a remotely located motor, belt drive systems, chain drive systems, etc.) could be coupled to spray head 18 to rotate same without departing from the scope of the present invention.

Spray head 18 has spray nozzles 20 mounted in/on a face thereof such that nozzles 20 directly oppose, but do not contact, surface 100 when system 10 is placed on surface 100. Generally, each of nozzles 20 is approximately the same distance from surface 100 when spray head 18 is mounted in carriage assembly 30 and placed on surface 100. Nozzles 20 dispense any fluid (e.g., water, a cleaning solution, etc.) or fluid-like substance under pressure where such fluid is directed at surface 100 when system 10 is positioned thereon. The supply of fluid to nozzles 20 will come from a pressurized source (not shown) that couples to nozzles 20 via conduits (not shown) as would be understood in the art. The type, number, angle of directivity, and/or placement of nozzles 20 are not limitations of the present invention. Nozzles 20 can be arranged to direct their spray substantially perpendicularly to surface 100 and to provide a spray pattern that will spray a swath of surface 100 as spray head 18 rotates.

As will be explained further below, spray head 18 is designed to generate a suction force (indicated by arrows 22) that tends to draw spray head 18 towards surface 100 during the rotation thereof. Suction force 22 should be sufficient to overcome the force of gravity acting on system 10 and the force generated as fluid under pressure exits spray nozzles 20 that tends to push system 10 away from surface 100. In this way, system 10 can operate on non-horizontal surfaces.

Carriage assembly 30 can be any movable support structure for motor 12/spindle 14/spray head 18 that positions spray nozzles 20 a selected standoff distance from surface 100 and moves spray head 18 over surface 100 without damaging surface 100. For example, carriage assembly 30 can include a rigid frame 32 and a number of omni-directional roller ball assemblies 34 coupled to frame 32. Assemblies 34 form the interface with surface 100 and are configured to ride on surface 100 without damage thereto. For example, assemblies 34 can utilize a ball 34A (e.g., a TEFLON ball) to interface with surface 100.

Figure 2:
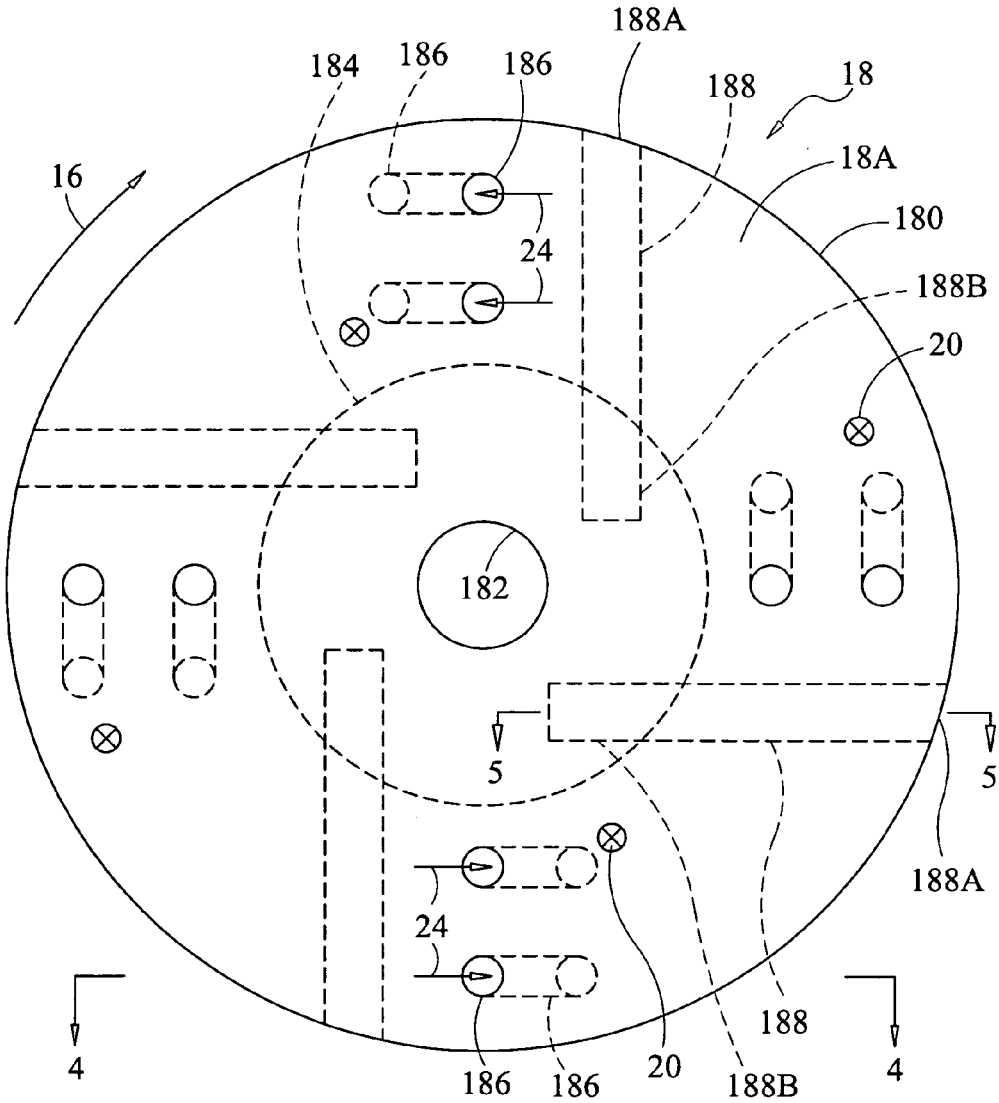
FIG. 2 is an isolated plan view of the nozzle side of a spray head in accordance with an embodiment of the present invention.
Figure 3:
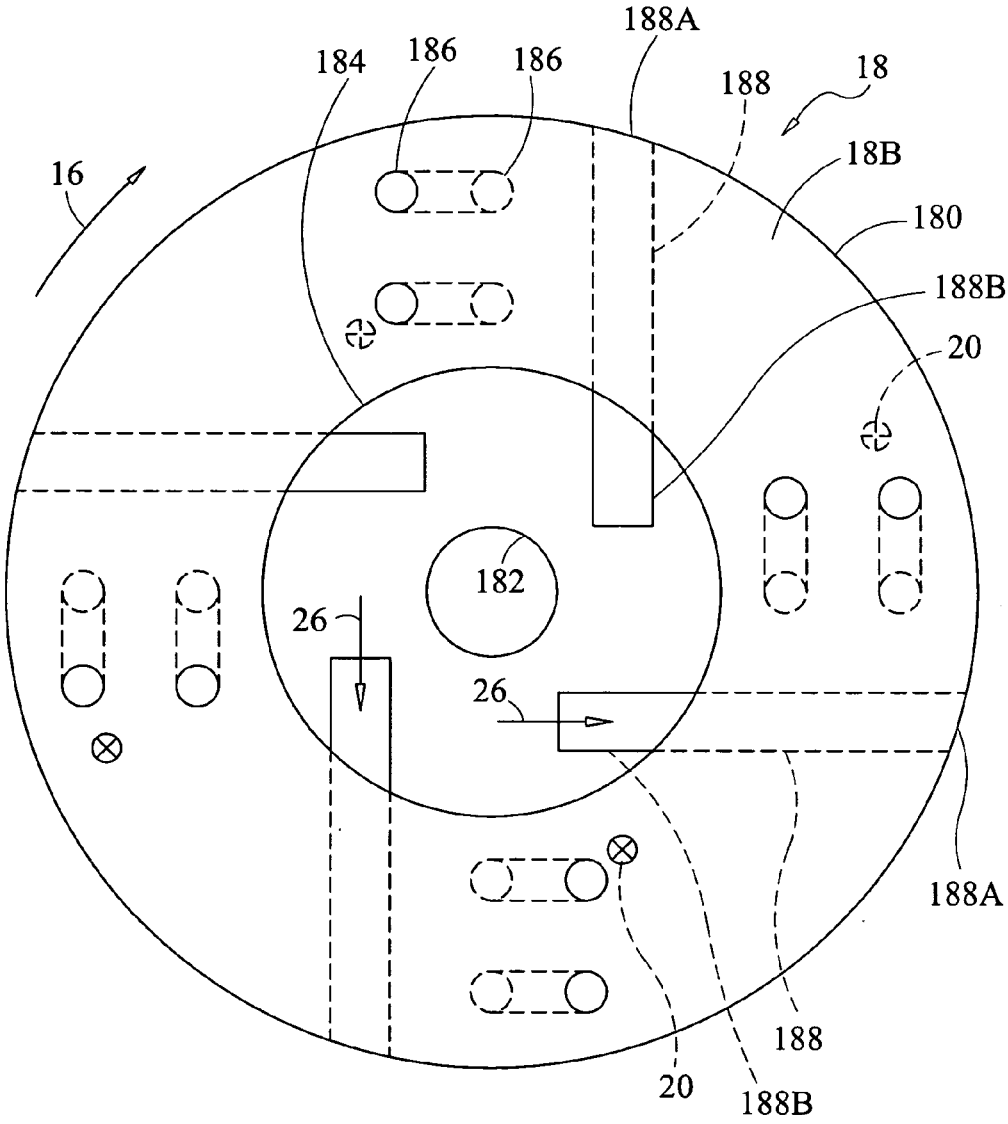
FIG. 3 is an isolated plan view of the backside of the spray head illustrated in FIG. 2.

As mentioned above, when spray head 18 rotates, suction forces 22 are generated. An exemplary spray head 18 capable of generating such suction forces will be explained with the aid of FIGS. 2-5. More specifically, FIG. 2 is a plan view of a non-limiting embodiment of spray head 18 from the nozzle side 18A thereof, and FIG. 3 is a plan view of spray head 18 from the side 18B opposite nozzle side 18A. Sides 18A and 18B can be parallel (as shown) or non-parallel to one another. In the illustrated embodiment, four spray nozzles 20 are shown. However, as mentioned above, the number, size, placement, etc., of nozzles 20 are not limitations of the present invention.

The body 180 of spray head 18 can be a circular disk. However, it is to be understood that the geometric shape of body 180 is not a limitation of the present invention. Further, body 180 can be made from metal, plastic, composite, etc., without departing from the scope of the present invention. Body 180 is generally solid except for regions thereof that are bored out as will be described below. Body 180 can include a central bore 182 for mounting to spindle 14 (or any other rotational drive structure) in any of a variety of ways where such mounting method is not a limitation of the present invention. Body 180 also includes a partially bored-out open region 184 that is initiated from side 18B. Region 184 can be cylindrical (as shown) or other geometric shape without departing from the scope of the present invention.

A number of bore holes 186 extend from nozzle side 18A to opposing side 18B. As will be explained further below, bore holes 186 provide a flow path from the surrounding fluid environment as spray head 18 rotates. The number, size, shape, and/or placement of bore holes 186 can be different than that illustrated. In general, the arrangement of bore holes 186 should be evenly distributed or balanced across sides 18A and 18B so that the suction forces generated by rotation 16 are balanced across spray head 18. In addition, when viewed relative to the direction of rotation 16, the position of bore holes 186 at nozzle side 18A should lead the position of bores holes 186 at opposing side 18B. For example, in the illustrated embodiment, each of bore holes 186 is a straight hole that is angularly disposed in a non-perpendicular fashion with respect to sides 18A and 18B as best seen in the cross-sectional view of spray head 18 illustrated in FIG. 4. The particular angles that bore holes 186 make with sides 18A and 18B are not limitations of the present invention. The angles can be the same for all of bore holes 186 or could be different without departing from the scope of the present invention. Further, bore holes 186 can be of constant diameter (as shown) or varying diameter, or can be straight (as shown) or curved along their lengths. Thus, in general, an imaginary line 186A (FIG. 4) drawn between the centers of a bore hole 186 at sides 18A and 18B will be non-perpendicular with respect to sides 18A and 18B.

The present invention also provides a number of peripheral bore holes/channels 188, each of which originates as a hole 188A in a peripheral edge of body 180 and terminates as an open channel 188B in bored-out region 184. The number, size, shape, and/or placement of holes/channels 188 are not limitations of the present invention. Similar to bore holes 186, holes/channels 188 are provided in a balanced distribution about body 180. In general, holes/channels 180 are aligned along chords of body 180 where such chords are not coincident with a diameter of body 180. In the illustrated embodiment with sides 18A and 18B being parallel to one another, holes/channels 188 are substantially parallel to sides 18A and 18B as best seen in the cross-sectional view presented in FIG. 5. Each open channel 188B is defined when hole 180 encounters and continues into the reduced thickness portion of body 180 defined by bored-out region 184.

Figure 4:
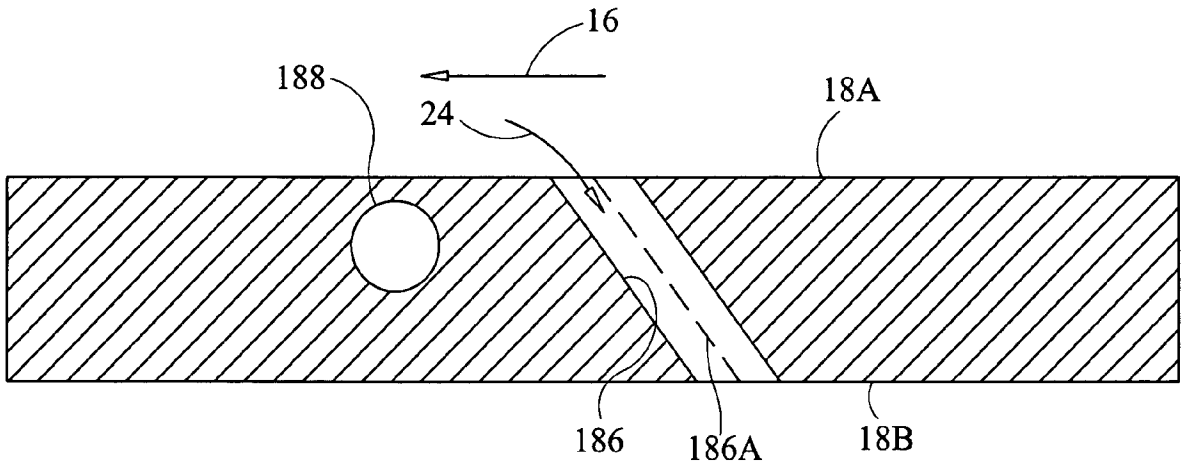
FIG. 4 is a cross-sectional view of the spray head taken along line 4-4 in FIG. 2.
Figure 5:
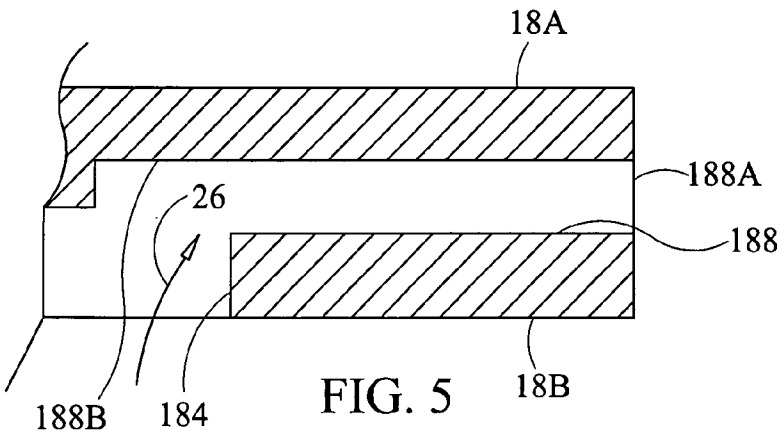
FIG. 5 is a cross-sectional view of a portion of the spray head taken along line 5-5 in FIG. 2.

In operation, when system 10 is positioned on surface 100 and spray head 18 is rotated, the fluid environment (e.g., water 200) is directed into bore holes 186 from nozzle side 18A (as indicated by arrows 24 in FIGS. 2 and 4). At the same time, the fluid environment is directed into channels 188B and then into holes 188 from side 18B (as indicated by arrows 26 in FIGS. 3 and 5). The fluid movement into and through bore holes 186 and holes/channels 188 generates a suction force (e.g., suction force 22 illustrated in FIG. 1) as the fluid is expelled from bore holes 186 at side 18B and from holes/channels 188 at the peripheral edge of body 180 at holes 188A. The amount of suction force generated can be adjusted for a given spray head configuration by adjusting the rotational speed thereof.

The advantages of the present invention are numerous. A surface can be sprayed/cleaned without damage thereto by the rotating spray head of the present invention. Rotation of the spray head generates suction forces to keep the spray head (and rotational system) in place on non-horizontal surfaces. Thus, the present invention is ideally suited to be used in the cleaning of a ship's hull that is finished with easy release coatings.

Although the invention has been described relative to a specific embodiment thereof, there are numerous variations and modifications that will be readily apparent to those skilled in the art in light of the above teachings. For example, the present invention is not limited to use in spraying activities. That is, the spray nozzles described herein could be replaced with any other element designed to "work" on a surface as the head was rotated thereover. Such work producing elements could include lasers, acoustic transducers, magnetic elements, etc., the choice of which is not a limitation of the present invention. It is therefore to be understood that the invention may be practiced other than as specifically described.

What is claimed as new and desired to be secured by Letters Patent of the United States is:

1. An element-support head for generating suction upon the rotation thereof, comprising:

a body defining a first surface, a second surface opposing said first surface, and a peripheral edge, said body further defining an open region formed in a central portion of said second surface;

a plurality of work producing elements mounted in said first surface;

a first plurality of holes formed through said body, each of said first plurality of holes extending between said first surface and said second surface; and a second plurality of holes formed through said body, each of said second plurality of holes extending between said peripheral edge of said body and said open region of said body, wherein rotation of said body generates a suction force at said first surface.

2. An element-support head as in claim 1, wherein said first surface is parallel to said second surface.

3. An element-support head as in claim 1, wherein each of said first plurality of holes comprises a straight hole.

4. An element-support head as in claim 1, wherein each of said first plurality of holes is aligned along a direction that is non-perpendicular to said first surface and said second surface.

5. An element-support head as in claim 2, wherein each of said first plurality of holes comprises a straight hole.

6. An element-support head as in claim 2, wherein centers of each of said first plurality of holes at said first surface and said second surface are aligned along a line that is non-perpendicular with respect to said first surface and said second surface.

7. An element-support head as in claim 1, wherein said first surface is parallel to said second surface, and wherein each of said first plurality of holes comprises a straight hole aligned along a direction that is non-perpendicular to said first surface and said second surface.

8. An element-support head as in claim 1, wherein each of said plurality of second holes is aligned along a non-diametrical chord of said body.

9. An element-support head as in claim 2, wherein each of said plurality of second holes is substantially parallel to said first surface and said second surface, and wherein each of said plurality of second holes is aligned along a non-diametrical chord of said body.

10. An element-support head as in claim 7, wherein each of said plurality of second holes is aligned along a non-diametrical chord of said body.

11. An element-support head as in claim 10, wherein each of said plurality of second holes is substantially parallel to said first surface and said second surface.

12. An element-support head as in claim 1, wherein each of said plurality of work producing elements comprises a spray nozzle.

13. A rotating sprayer system, comprising:

a body defining a first surface, a second surface opposing said first surface, and a peripheral edge, said body further defining an open region formed in a central portion of said second surface;

a plurality of spray nozzles mounted in said first surface;

a first plurality of holes formed through said body, each of said first plurality of holes extending between said first surface and said second surface along a direction that is non-perpendicular to said first surface and said second surface;

a second plurality of holes formed through said body, each of said second plurality of holes extending between said peripheral edge of said body and said open region of said body; and a rotational drive structure coupled to said body for rotating said body in a direction of rotation wherein, for each of said first plurality of holes, a position thereof at said first surface leads a position thereof at said second surface relative to said direction of rotation wherein a suction force is generated at said first surface as said body rotates in said direction of rotation.

14. A rotating sprayer system as in claim 13, further comprising a carriage structure coupled to said rotational drive structure wherein said body is supported during rotation thereof and is adapted to be held in a spaced-apart relationship with a surface of interest.

15. A rotating sprayer system as in claim 13, wherein said first surface is parallel to said second surface.

16. A rotating sprayer system as in claim 13, wherein each of said first plurality of holes comprises a straight hole.

17. A rotating sprayer system as in claim 13, wherein each of said plurality of second holes is aligned along a non-diametrical chord of said body.

18. A rotating sprayer system as in claim 15, wherein each of said plurality of second holes is substantially parallel to said first surface and said second surface, and wherein each of said plurality of second holes is aligned along a non-diametrical chord of said body.

19. A rotating sprayer system comprising:

a body defining a first surface, a second surface opposing and parallel to said first surface, and a peripheral edge, said body further defining an open region formed in a central portion of said second surface;

a plurality of spray nozzles mounted in said first surface;

a first plurality of holes formed through said body, each of said first plurality of holes being a straight holes extending between said first surface and said second surface along a direction that is non-perpendicular to said first surface and said second surface;

a second plurality of holes formed through said body and aligned along a non-diametrical chord of said body, each of said second plurality of holes extending between said peripheral edge of said body and said open region of said body; and a rotational drive structure coupled to said body for rotating said body in a direction of rotation wherein, for each of said first plurality of holes, a position thereof at said first surface leads a position thereof at said second surface relative to said direction of rotation, and wherein a suction force is generated at said first surface as said body rotates in said direction of rotation.

20. A rotating sprayer system as in claim 19, wherein said peripheral edge is circular.

21. A rotating sprayer system as in claim 19, further comprising a carriage structure coupled to said rotational drive structure wherein said body is supported during rotation thereof and is adapted to be held in a spaced-apart relationship with a surface of interest.

22. A rotating sprayer system as in claim 19, wherein each of said plurality of second holes is substantially parallel to said first surface and said second surface.

* * * * *